US012066243B2

(12) United States Patent
Sim et al.

(10) Patent No.: US 12,066,243 B2
(45) Date of Patent: Aug. 20, 2024

(54) SHELF ASSEMBLY OF REFRIGERATOR

(71) Applicant: LG Electronics Inc., Seoul (KR)

(72) Inventors: Hyehyun Sim, Seoul (KR); Jungil Shin, Seoul (KR); Ji Hoon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/641,366

(22) PCT Filed: Jul. 31, 2020

(86) PCT No.: PCT/KR2020/010163
§ 371 (c)(1),
(2) Date: Mar. 8, 2022

(87) PCT Pub. No.: WO2021/054602
PCT Pub. Date: Mar. 25, 2021

(65) Prior Publication Data

US 2024/0044575 A1 Feb. 8, 2024

(30) Foreign Application Priority Data

Sep. 18, 2019 (KR) ..... 10-2019-0114872

(51) Int. Cl.
*F25D 25/02* (2006.01)

(52) U.S. Cl.
CPC ..... *F25D 25/02* (2013.01); *F25D 2325/021* (2013.01)

(58) Field of Classification Search
CPC .... F25D 25/02; F25D 2325/021; F25D 25/04; F25D 25/024; F25D 23/067; A47B 57/06;
(Continued)

(56) References Cited

U.S. PATENT DOCUMENTS 3,610,174 A * 10/1971 Kesling ..... F25D 23/04 108/146
5,199,778 A * 4/1993 Aoki ..... F25D 25/02 108/147

(Continued)

FOREIGN PATENT DOCUMENTS

EP 1895253 3/2008
EP 2395876 12/2011

(Continued)

OTHER PUBLICATIONS

English translation for EP1895253 (Year: 2008).*
EP Extended European Search Report in European Appln. No. 20866876.4, mailed on Aug. 24, 2023, 8 pages.

*Primary Examiner* — Hiwot E Tefera
(74) *Attorney, Agent, or Firm* — Fish & Richardson P.C.

(57) ABSTRACT

Proposed is a refrigerator having a shelf assembly in which the shelf assembly includes a shelf installed inside a cabinet defining a storage space of the refrigerator and allowing food and a container to be seated thereon, a shelf fixing bracket fixed to each of opposite sides of the shelf and supporting the shelf, a lift rail module installed to be vertically long inside the cabinet such that the shelf fixing bracket is vertically movable, and a lift module installed slidably on one side of the shelf and configured to selectively release the shelf fixing bracket held by the lift rail module according to a user's manipulation.

9 Claims, 14 Drawing Sheets

(58) Field of Classification Search
CPC ..... A47B 96/025; A47B 2210/175; A47B 96/024; A47B 57/30; A47B 96/062; A47B 57/20; A47B 96/061
See application file for complete search history.

(56) References Cited

U.S. PATENT DOCUMENTS

| | | | | |
|---|---|---|---|---|
| 5,913,584 | A * | 6/1999 | Swindell | F25D 25/02 248/292.12 |
| 6,065,821 | A * | 5/2000 | Anderson | A47B 57/06 248/292.12 |
| 7,178,890 | B2 * | 2/2007 | Park | F25D 25/02 312/408 |
| 10,161,671 | B2 * | 12/2018 | Chellappan | F25D 11/02 |
| 10,376,058 | B2 * | 8/2019 | Bryan | A47B 96/025 |
| 11,125,491 | B2 * | 9/2021 | Allgeier | F25D 25/02 |
| 11,209,206 | B2 * | 12/2021 | Lee | F25D 25/005 |
| 2008/0246382 | A1 * | 10/2008 | Kang | A47B 57/06 312/408 |
| 2009/0255292 | A1 * | 10/2009 | Benz | A47B 57/06 700/275 |
| 2010/0060125 | A1 * | 3/2010 | Kang | A47B 57/06 312/408 |
| 2015/0076985 | A1 * | 3/2015 | Yoo | F25D 23/00 312/306 |
| 2019/0075924 | A1 * | 3/2019 | Nuss | A47B 57/08 |

FOREIGN PATENT DOCUMENTS

| | | |
|---|---|---|
| JP | H0345882 A | 2/1991 |
| KR | 20130068554 | 6/2013 |

* cited by examiner

SHELF ASSEMBLY OF REFRIGERATOR

CROSS-REFERENCE TO RELATED APPLICATIONS

This application is a National Stage application under 35 U.S.C. § 371 of International Application No. PCT/KR2020/010163, filed on Jul. 31, 2020, which claims the benefit of Korean Patent Application No. 10-2019-0114872, filed on Sep. 18, 2019. The disclosures of the prior applications are incorporated by reference in their entirety.

TECHNICAL FIELD

The present disclosure relates generally to a refrigerator comprising a shelf assembly. More particularly, the present disclosure relates to a refrigerator comprising a shelf assembly in which the height of a shelf can be adjusted by a user's simple manipulation.

BACKGROUND ART

Generally, a shelf of a refrigerator is installed inside the refrigerator and is a part on which food of various sizes and containers in which food is stored are seated.

Containers or items seated on the shelf are not uniform in height, and containers or items having various heights are seated on the shelf according to the needs of a user.

In a storage space of a cabinet, the shelf is formed in multiple levels so as to divide the storage space into several compartments, and food and food storage containers are directly stored in each of the compartments of the storage space.

According to the height of food and a food storage container seated on the upper surface of such a shelf, the shelf is configured to be adjustable in height.

The conventional height adjustment structure of the shelf is disclosed in Korean Patent Application Publication No. 10-2017-0126575 and Korean Patent Application Publication No. 10-2018-0049931.

In Korean Patent Application Publication No. 10-2017-0126575, a rack bar is installed on each of the opposite sides of the rear wall body of a cabinet such that the rack bar is formed to be vertically long thereon and has a plurality of holding grooves formed therein, and a shelf fixing bracket supporting the shelf is installed on each of the opposite sides of the lower surface of the shelf.

A hook-shaped fixing part is formed on the rear end of the shelf fixing bracket installed on the lower part of the shelf such that the shelf is fixed to have the shape of a cantilever in the storage space of the cabinet.

During the height adjustment of the shelf, the shelf is completely removed from the rack bar and the hook-shaped fixing part is inserted into a holding groove located at a position desired by a user such that the shelf can be held.

In Korean Patent Application Publication No. 10-2018-0049931, a refrigerator in which the height adjustment of the shelf can be performed is disclosed, and the refrigerator includes a main body, a storage compartment provided inside the main body, a shelf hanger provided inside the storage compartment, a moving unit coupled to the shelf hanger such that the moving unit is movable in a vertical direction, and a shelf supported by the moving unit.

According to such a conventional refrigerator in which the shelf is adjustable in height, a plurality of holding jaws are formed on one side of the shelf hanger, and a holding lever supported elastically by each of the holding jaws is held by the holding jaw so as to hold the shelf.

During the height adjustment of the shelf, while a user grips a switching bar by which the holding lever is held, the user rotates the switching bar forward and releases the holding lever held by the holding jaw such that the height adjustment of the shelf can be performed along the guide groove of the shelf hanger.

In the case of Korean Patent Application Publication No. 10-2017-0126575, the structure of the refrigerator may be simple, but is configured such that while the shelf is completely removed from the rack bar in which the shelf is held, the shelf is held at a position desired by a user, so usability of the refrigerator is reduced and during disassembly and assembly of the shelf, the shelf may collide with surrounding objects and may be damaged.

In the case of Korean Patent Application Publication No. 10-2018-0049931, the refrigerator is configured such that while the shelf is held by the shelf hanger, the height of the shelf can be adjusted, but the switching bar for the height adjustment of the shelf is located in the innermost part of a cabinet, so a user's manipulation for the height adjustment of the shelf is very difficult.

DISCLOSURE

Technical Problem

Accordingly, the present disclosure has been made to solve the above problems occurring in the prior art, and the present disclosure is intended to propose a refrigerator comprising a shelf assembly in which a handle part of a lift module is installed on the front of a shelf and thus the handle part for the height adjustment of the shelf may be located to be adjacent to a user such that manipulation for the height adjustment of the shelf is facilitated.

In addition, the present disclosure is intended to propose a refrigerator comprising a shelf assembly in which a holding member installed on each of a pair of lift rail modules may be easily held therein and released therefrom by sliding the handle part.

Furthermore, the present disclosure is intended to propose a refrigerator comprising a shelf assembly in which a holding protrusion is formed on each of the front and rear of a lift body held in each of the lift rail modules, and due to the rotation of the lift body, the holding protrusions of the front and rear of the lift body are simultaneously held in the lift rail module so as to have a more secure shelf holding force.

Technical Solution

In order to accomplish the above objectives, according to an aspect of the present disclosure, in a refrigerator comprising a shelf assembly of the present disclosure, a handle part for the height adjustment of the shelf may be installed on the front of a shelf, so accessibility to the handle part for the height adjustment of the shelf and manipulability may be improved.

In addition, in the refrigerator comprising a shelf assembly of the present disclosure, first and second gear parts may be simultaneously operated by the sliding of the handle part, and thus two holding members may be simultaneously held or released.

Furthermore, in the refrigerator comprising a shelf assembly of the present disclosure, the handle part may be formed to be integrated with a first gear part such that the number of parts can be minimized and the performance of assembly and disassembly can be improved.

Additionally, in the refrigerator comprising a shelf assembly of the present disclosure, a rotating gear part may be installed between the first gear part and a second gear part such that the operation force of the first gear part can be transmitted to the second gear part with a simple configuration.

In addition, in the refrigerator comprising a shelf assembly of the present disclosure, the back and forth moving member may include a connection bar, a back and forth moving bar, and a rotation guide bar, and may be configured such that each of the components is easily assembled with each other.

Furthermore, in the refrigerator comprising a shelf assembly of the present disclosure, a lift body may be installed to be vertically movable along the inside of a lift rail module, and the lift body may be selectively held in the lift rail module by the holding protrusions of the lift body.

Additionally, in the refrigerator comprising a shelf assembly of the present disclosure, rollers may be installed respectively on the upper and lower sides of the lift body such that during the vertical movement of the lift body, the vertical movement of the lift body can be efficiently performed.

In addition, in the refrigerator comprising a shelf assembly of the present disclosure, the holding protrusions may be formed respectively on the front and rear of the lift body, and when holding the shelf, the holding protrusions of the front and rear of the lift body may be simultaneously held respectively in holding recesses of the lift rail module such that the shelf can be securely held by the lift rail module.

Advantageous Effects

The refrigerator comprising a shelf assembly of the present disclosure may have the following effects.

According to the present disclosure, the handle part for the height adjustment of the shelf may be installed on the front of the shelf and thus the handle part for the height adjustment of the shelf may be installed at a position adjacent to a user, thereby improving the usability and manipulability of the handle part.

In addition, the first and second gear parts may be simultaneously operated by the sliding of the handle part and thus the two holding members may be simultaneously held or released, thereby improving the performance of assembly and disassembly due to decrease of the number of parts.

Furthermore, the holding protrusion may be formed on each of the front and rear of the lift body held in the lift rail module, and due to the rotation of the lift body, the holding protrusions of the front and rear of the lift body may be held in the lift rail module, thereby having a more secure shelf holding force.

BEST MODE

Hereinafter, an exemplary embodiment of a refrigerator comprising a shelf assembly according to the present disclosure will be described in detail with reference to the accompanying drawings.

Figure 1:
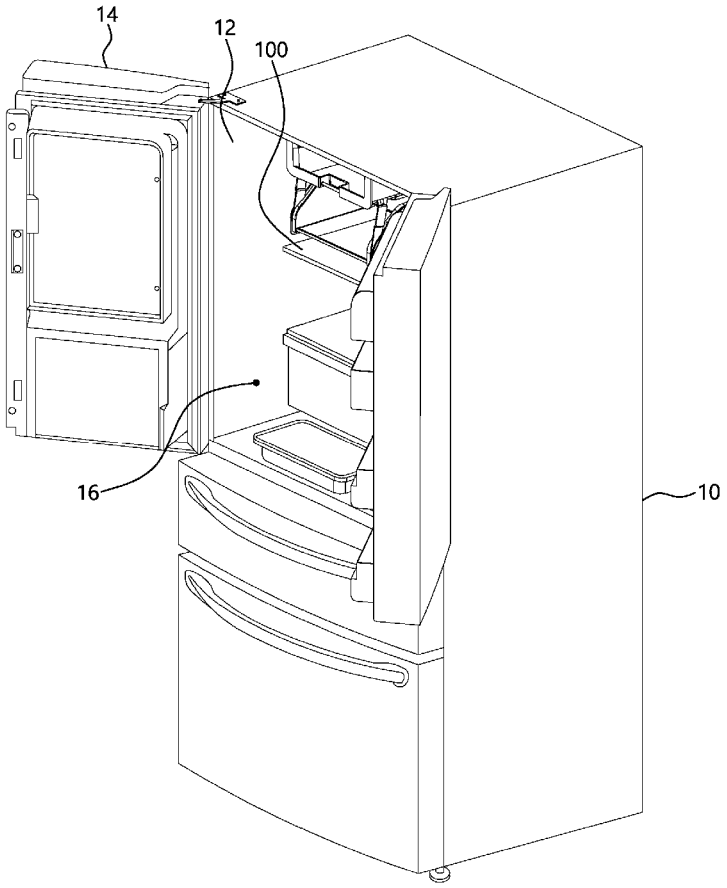
FIG. 1 is a perspective view illustrating a state in which a shelf assembly is mounted inside a refrigerator of the present disclosure.
Figure 2:
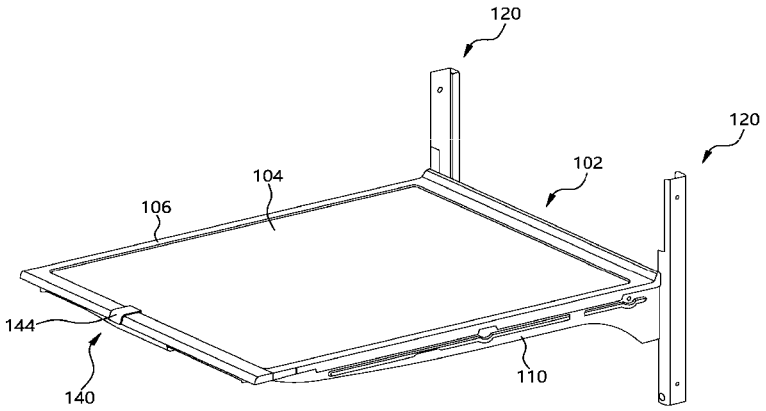
FIG. 2 is a perspective view illustrating the configuration of the shelf assembly according to the exemplary embodiment of the present disclosure.
Figure 3:
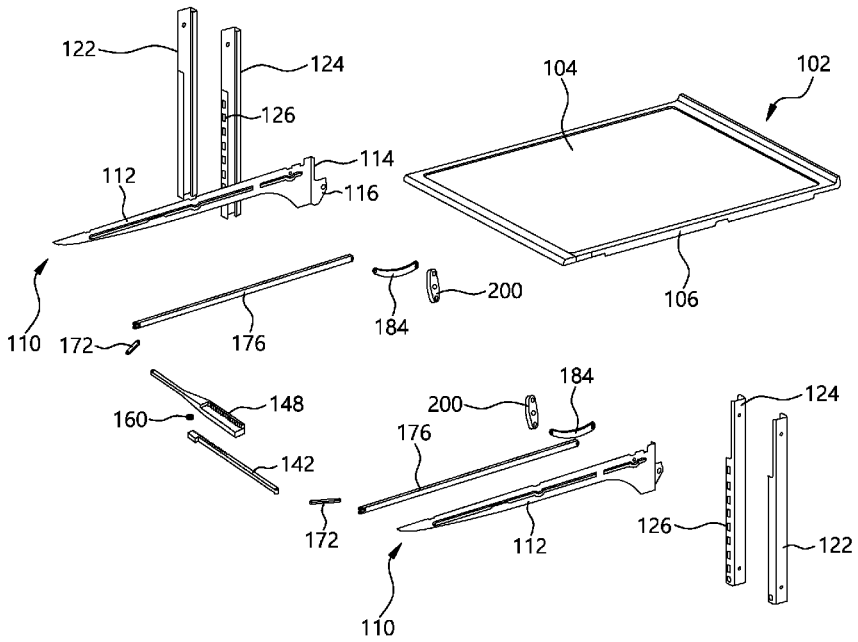
FIG. 3 is an exploded perspective view illustrating the configuration of the shelf assembly according to the exemplary embodiment of the present disclosure.
Figure 4:
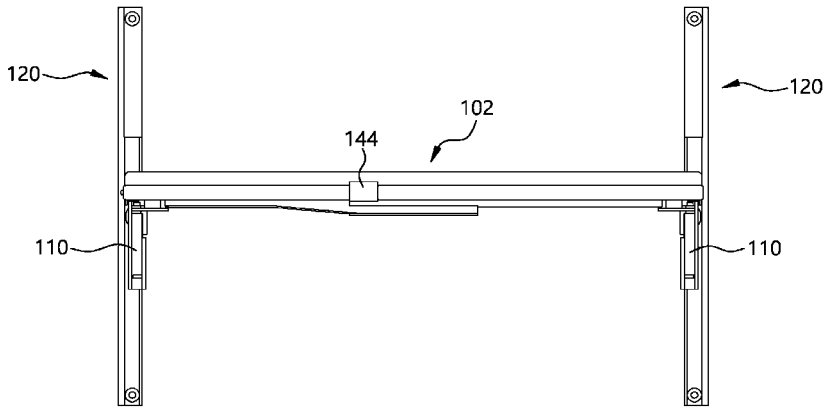
FIG. 4 is a front view illustrating the configuration of the shelf assembly according to the exemplary embodiment of the present disclosure.
Figure 5:
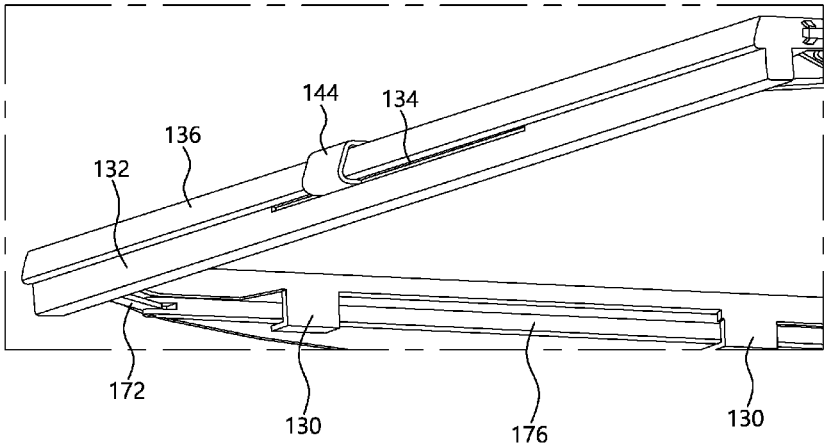
FIG. 5 is an enlarged view illustrating the front lower part of the shelf assembly according to the present disclosure.
Figure 6:
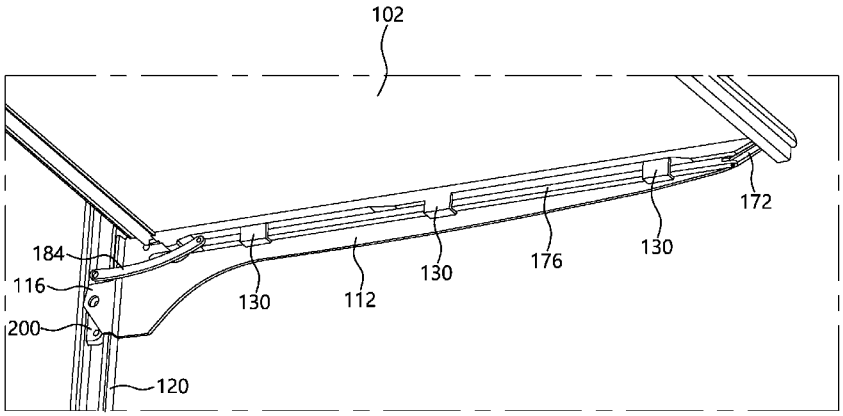
FIG. 6 is an enlarged view illustrating the lower side surface of the shelf assembly according to the present disclosure.

FIG. 1 illustrates a perspective view illustrating a state in which a shelf assembly is mounted inside a refrigerator of the present disclosure, FIG. 2 illustrates a perspective view illustrating the configuration of the shelf assembly according to the exemplary embodiment of the present disclosure. FIG. 3 illustrates an exploded perspective view illustrating the configuration of the shelf assembly according to the exemplary embodiment of the present disclosure, FIG. 4 illustrates a front view illustrating the configuration of the shelf assembly according to the exemplary embodiment of the present disclosure, FIG. 5 illustrates an enlarged view illustrating the front lower part of the shelf assembly according to the present disclosure, and FIG. 6 illustrates an enlarged view illustrating the lower side surface of the shelf assembly according to the present disclosure.

As illustrated in FIGS. 1 to 6, the shelf assembly 100 of the refrigerator of the present disclosure may include a shelf 102 installed inside a cabinet defining the storage space of the refrigerator and allowing food and a container to be seated thereon, a shelf fixing bracket 110 fixed to each of the opposite sides of the shelf 102 and supporting the shelf 102, a lift rail module 120 installed to be vertically long inside the cabinet such that the shelf fixing bracket 110 is vertically movable, and a lift module 140 installed slidably on one side of the shelf and configured to selectively release the shelf fixing bracket 110 held by the lift rail module 120 according to a user's manipulation.

Referring to FIG. 1, the refrigerator may include a main body 10 constituting an exterior thereof, the cabinet 12 defining the storage space in the main body, a door 14 provided on the front of the cabinet 12 so as to open and close the cabinet 12, a cold air supply device (not shown) for supplying cold air into the cabinet 12, and a machine room (not shown) provided in the lower rear part of the main body such that electric parts such as a compressor are installed in the machine room.

The refrigerator may include a refrigeration cycle which is composed of a compressor, a condenser, an expander, and an evaporator so as to generate cold air discharged through the cold air supply device.

The shelf assembly 100 may be installed in the storage space of the cabinet 12. The shelf assembly 100 may include the shelf 102, the shelf fixing bracket 110, the lift rail module 120, and the lift module 140.

The shelf 102 is a general shelf, so detailed description thereof will be omitted. The shelf 102 may be composed of a support plate 104 and a fixing frame 106.

The support plate 104 may be made of a transparent material and may be formed to have the shape of a rectangular plate. A material applied to the support plate 104 may be plastic, tempered glass, or metal, and the tempered glass will be applied herein.

The upper surface of the support plate 104 may be a part on which food and a food container are seated to be stored.

The fixing frame 106 may be installed on an edge part of the support plate 104. The fixing frame 106 may be made of a plastic frame and may be installed to cover the edge part of the support plate 104. The fixing frame 106 may function to protect the edge part of the support plate 104 and to support the support plate 104.

The shelf fixing bracket 110 may be installed on each of the lower opposite sides of the shelf 102 (see FIG. 3). The shelf fixing bracket 110 may be composed of a support piece 112 made of a plate having a predetermined thickness and formed to be long in a front-to-rear direction, a bent piece 114 formed on the end part of the support piece 112 by bending therefrom and formed by extending from the support piece 112, and a fixing piece 116 formed on the bent piece 114 by protruding rearward therefrom and fixed inside the refrigerator.

The support piece 112 may be made of a steel frame and may be formed to be long in the front-to-rear direction. The support piece 112 may be installed on each of the opposite sides of the lower surface of the shelf 102 by standing and may support the opposite sides of the lower surface of the shelf 102.

The bent piece 114 may be formed on the rear end of the support piece 112. The bent piece 114 may be formed to be integrated with the support piece 112 and may be formed by bending in a direction toward the inner side of the shelf 102. The bent piece 114 may be formed on the rear end of the support piece 112 by bending therefrom and may function to support the rear lower surface of the shelf 102.

The fixing piece 116 may be formed on the side surface of the bent piece 114. The fixing piece 116 may be formed to be integrated with the bent piece 114 and may be formed by protruding rearward from the bent piece. A lift body fixing hole 118 may be formed in the side surface of the fixing piece 116 by passing therethrough in a side to side direction. The fixing piece 116 may protrude rearward and may be a part mounted to a holding member 200 to be described later by inserting a bracket fixing pin 119 into the lift body fixing hole 118.

That is, the shelf fixing bracket 110 may be installed on each of the opposite sides of the lower surface of the shelf 102 so as to support the lower surface of the shelf, and may be fixed to the holding member 200 to be described later, so the position of the shelf fixing bracket 110 may be fixed inside the storage space 16.

The lift rail module 120 may be installed on the rear of the inner surface of the cabinet 12. The lift rail module 120 may include multiple lift rail modules according to the arrangement of the shelf 102 installed inside the cabinet 12.

When a shelf is arranged in one row relative to a vertical direction inside the cabinet 12, a pair of lift rail modules 120 may be installed, and when shelves are arranged in two rows relative to the vertical direction inside the cabinet 12, two pairs of lift rail modules 120 may be installed.

In the present disclosure, the lift rail module 120 will be described on the basis of a case in which the shelf 102 is arranged in one row.

The lift rail module 120 may be installed on each of the opposite sides of the rear wall surface of the cabinet 12. The lift rail module 120 may be composed of a refrigerator-fixed rail 122 and a shelf holding rail 124.

The refrigerator-fixed rail 122 may be made of a frame having a "U" shape in cross section and may be formed to be vertically long. An opening part may be formed in a side surface (in a shelf installation direction) of the refrigerator-fixed rail 122 and may be a part into which the shelf holding rail 124 to be described later is inserted.

The refrigerator-fixed rail 122 may be fixedly installed on the side surface or rear of the inside of the cabinet 12, and may function to fix the shelf holding rail 124 to be described later inside the cabinet 12.

The shelf holding rail 124 may be installed inside the refrigerator-fixed rail 122. The shelf holding rail 124 may be configured to have the same shape as the shape of the refrigerator-fixed rail 122 and to be smaller in diameter and width than the refrigerator-fixed rail 122 such that the shelf holding rail 124 can be received in the refrigerator-fixed rail 122.

An opening part may be formed in the side surface (in the shelf installation direction) of the shelf holding rail 124 and may be a part into which the holding member 200 to be described later is inserted.

In addition, holding recesses 126 may be formed in the front and rear surfaces of the shelf holding rail 124. The holding recesses 126 may be formed through the shelf holding rail 124 in a front-to-rear direction thereof and may have a plurality of holding recesses formed at predetermined intervals along the front and rear surfaces of the shelf holding rail.

Each of the holding recess 126 may be a part into which a holding protrusion 220 of the holding member 200 to be described later is inserted to be held therein.

Support ends 130 may be formed on each of the opposite sides of the lower surface of the fixing frame 106. As illustrated in FIG. 5, each of the support ends 130 may have an "L" shape in cross section and may be formed on each of the opposite sides of the lower surface of the shelf 102 by protruding therefrom. The support ends 130 may be formed at a predetermined interval along each of the opposite sides of the lower surface of the shelf 102 by protruding therefrom, and may support a back and forth moving bar 176 to be described later.

A lift module receiving part 132 may be formed on the front of the shelf 102. The lift module receiving part 132 may have an "L" shape (see FIG. 11) and may be formed to be long in a side to side direction along the front lower side of the shelf 102.

The lift module receiving part 132 may be a part in which the lift module 140 to be described later is installed to be fixed.

A sliding hole 134 may be formed in the front center part of the lift module receiving part 132. The sliding hole 134 may be formed to be long in the side to side direction through the front center part of the lift module receiving part 132 such that the sliding hole has the shape of a long hole.

A handle part 144 to be described later may be installed in the sliding hole 134 by passing therethrough, and may slide leftward and rightward along the sliding hole 134.

Figure 7:
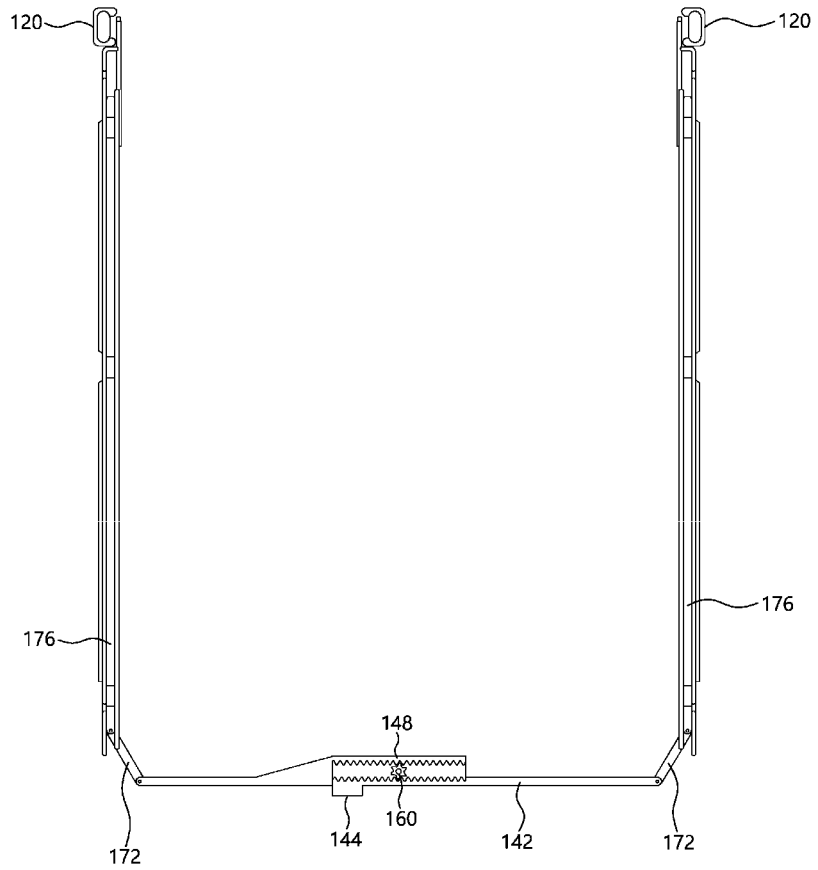
FIG. 7 is a cross sectional view illustrating the configuration of a lift module constituting the refrigerator according to the embodiment of the present disclosure.
Figure 8:
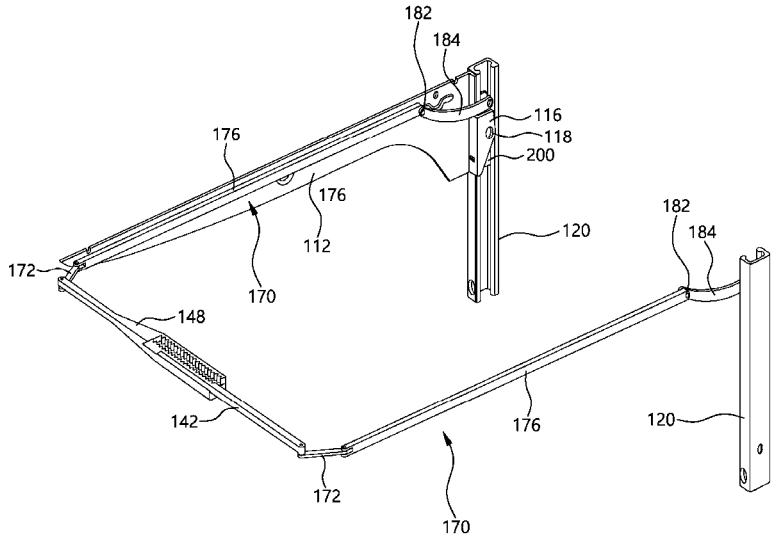
FIG. 8 is a perspective view illustrating the configuration of the lift module constituting the refrigerator according to the embodiment of the present disclosure.
Figure 9:
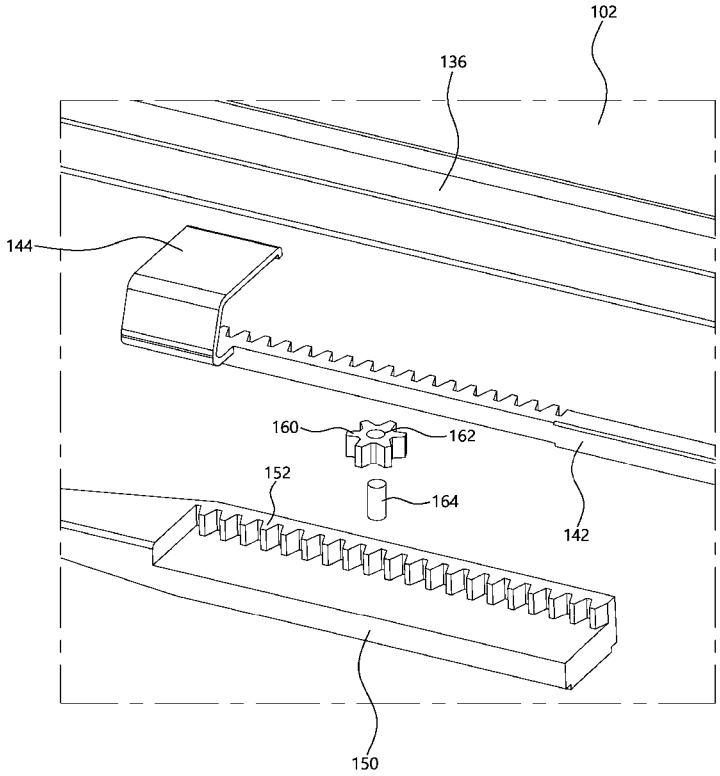
FIG. 9 is an exploded view illustrating a state in which the first and second gear parts and a rotating gear part are removed from a shelf according to the embodiment of the present disclosure.
Figure 10:
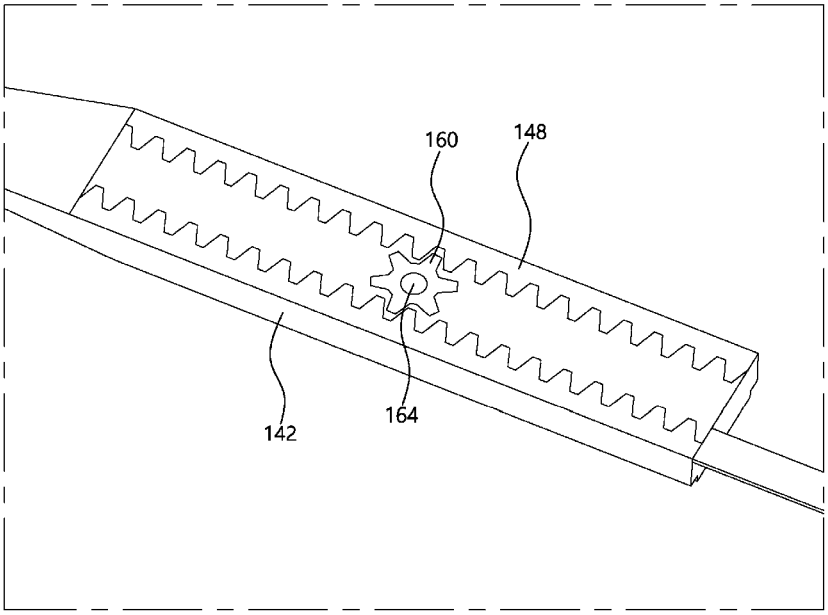
FIG. 10 is a horizontal sectional view illustrating a state in which the rotating gear part is assembled with the first and second gear parts therebetween according to the embodiment of the present disclosure.
Figure 11:
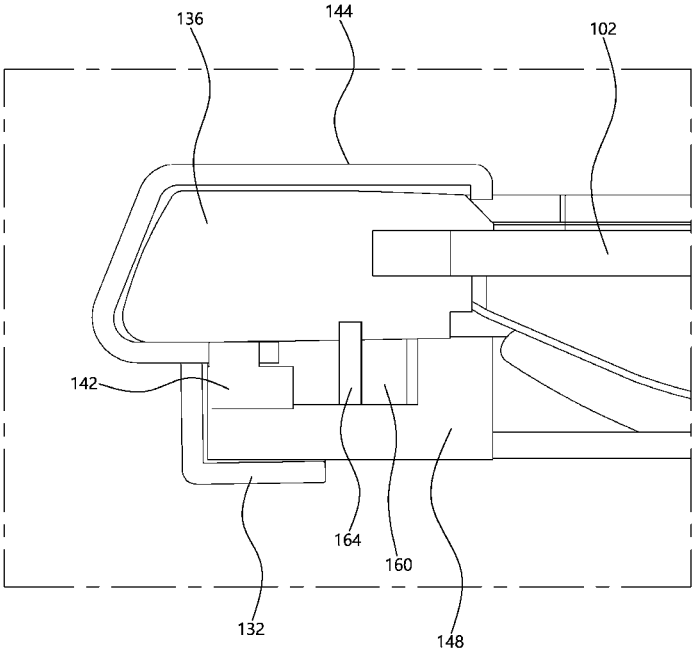
FIG. 11 is a vertical sectional view illustrating a state in which the first and second gear parts and the rotating gear part are assembled with the shelf according to the embodiment of the present disclosure.

FIG. 7 illustrates a cross sectional view illustrating the configuration of the lift module constituting the refrigerator according to the embodiment of the present disclosure, FIG. 8 illustrates a perspective view illustrating the configuration of the lift module constituting the refrigerator according to the embodiment of the present disclosure, FIG. 9 illustrates an exploded view illustrating a state in which the first and second gear parts and a rotating gear part are removed from the shelf according to the embodiment of the present disclosure, FIG. 10 illustrates a horizontal sectional view illustrating a state in which the rotating gear part is assembled with the first and second gear parts therebetween according to the embodiment of the present disclosure, and FIG. 11 illustrates a vertical sectional view illustrating a state in which the first and second gear parts and the rotating gear part are assembled with the shelf according to the embodiment of the present disclosure.

As illustrated in FIGS. 7 to 11, the lift module 140 may be installed under the shelf 102. The lift module 140 may include a first gear part 142 installed on one side of the shelf 102 such that the lift module can move leftward and rightward and having a plurality of teeth formed along one surface thereof, a second gear part 148 installed on one side of the shelf 102 such that the second gear part can move leftward and rightward and having a plurality of teeth formed along one surface thereof, the rotating gear part 160 installed between the first gear part 142 and the first gear part 142 and having a plurality of teeth formed along a circumferential surface thereof such that the first gear part 142 and the second gear part 148 are engaged with each other, the handle part 144 provided on one side of the first gear part 142 and installed to cover the front edge part of the shelf 102, the handle part being configured to move the first gear part 142 leftward or rightward according to a user's manipulation, the back and forth moving member 170 connected to each of the first and second gear parts 142 and 148 and installed on one side of the shelf so as to move forward/rearward, and the holding member 200 connected to the back and forth moving member 170 and installed inside the lift rail module 120, the holding member selectively being held by the lift rail module 120 according to the forward/rearward movement of the back and forth moving member 170.

The first gear part 142 may be formed to have the shape of a bar and to be long in the side to side direction. The first gear part 142 may have a plurality of teeth formed on a rear surface thereof to be long in the side to side direction. The first gear part 142 may be installed inside the lift module receiving part 132 such that the first gear part can move leftward and rightward. The first gear part 142 may move leftward or rightward according to the manipulation of the handle part 144 to be described later and may function to rotate the rotating gear part 160 to be described later.

The handle part 144 may be formed on the front surface of the left end of the first gear part 142. The handle part 144 may be formed to be integrated with the first gear part 142. As illustrated in FIG. 9, the handle part 144 may be made of a plate material having a predetermined thickness and may be formed by being bent to have a shape corresponding to the outer surface of a front edge part 136 of the shelf 102.

The handle part 144 may be installed to cover the front edge part 136 of the shelf 102. The handle part 144 may be a part gripped by a user during the height adjustment of the shelf 102, and may move leftward or rightward along the sliding hole 134 according to a user's manipulation.

In addition, when the handle part 144 moves leftward or rightward, the first gear part 142 formed integrally with the handle part 144 may move leftward or rightward so as to rotate the rotating gear part 160 to be described later.

A first coupling hole 146 may be formed in the right end part of the first gear part 142. The first coupling hole 146 may be formed vertically through the upper surface of the right end of the first gear part 142. A coupling pin (not shown) may be installed through and fastened in the first coupling hole 146.

The second gear part 148 may be installed under the first gear part 142. The second gear part 148 may be composed of a supporting plate 150, a rack gear 152, and an extension frame 154.

The supporting plate 150 may be made of a plate having a predetermined thickness, and may be formed to be long in the side to side direction. The upper surface of the supporting plate 150 may be a part on which a portion of the first gear part 142 and the rotating gear part 160 to be described later are seated to be supported.

The rack gear 152 may be formed on the rear of the upper surface of the supporting plate 150. The rack gear 152 is a general rack gear, so detailed description thereof will be omitted. The rack gear 152 may be formed to be long in the side to side direction along the upper surface of the supporting plate 150. Teeth (not shown) of the rack gear 152 may be disposed at the side of the first gear part 142, and may be formed to be long in the side to side direction.

The rack gear 152 may be engaged with the rotating gear part 160 to be described later, and may be moved in a left or right direction according to the clockwise or counterclockwise rotation of the rotating gear part 160.

A connection frame 154 may be formed on the left of the supporting plate 150. The connection frame 154 may be formed to be integrated with the supporting plate 150 and to have the shape of a bar such that the connection frame is long in the side to side direction. The back and forth moving member 170 to be described later may be connected to the left end part of the connection frame 154. The connection frame 154 may be moved leftward/rightward according to the leftward/rightward movement of the rack gear 152 and may function to move the back and forth moving member 170 to be described later forward/rearward.

A second coupling hole 156 may be formed in the left end part of the extension frame 154. The second coupling hole 156 may be formed vertically through the upper surface of the left end part of the extension frame 154. A coupling pin (not shown) may be installed by being inserted into the second coupling hole 156 such that a connection bar 172 to be described later is fixed rotatably to the extension frame 154.

The rotating gear part 160 may be installed between the first gear part 142 and the second gear part 148. The rotating gear part 160 is a general rotating gear, so detailed description thereof will be omitted. A rotating pin hole 162 may be formed in the center of the upper surface of the rotating gear part 160. The rotating pin hole 162 may be formed vertically through the center of the upper surface of the rotating gear part 160. A rotating pin 164 may be inserted into and pass through the rotating pin hole 162 and thus the rotating gear part 160 may be fixed rotatably to the center of the front lower surface of the shelf 102.

In addition, the first gear part 142 and the second gear part 148 located respectively at the front and rear sides of the rotating gear part 160 may be engaged with each other. The rotating gear part 160 may receive a rotational force caused by the leftward/rightward movement of the first gear part 142 and may function to move the second gear part 148 in a leftward or rightward direction.

Figure 12:
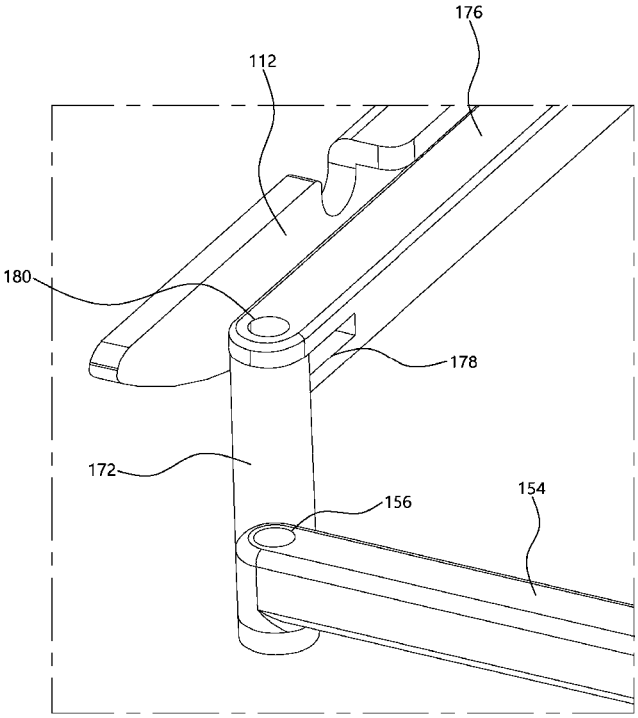
FIG. 12 is a partially enlarged view illustrating a state in which a back and forth moving member is fixed to a first gear part according to the embodiment of the present disclosure.
Figure 13:
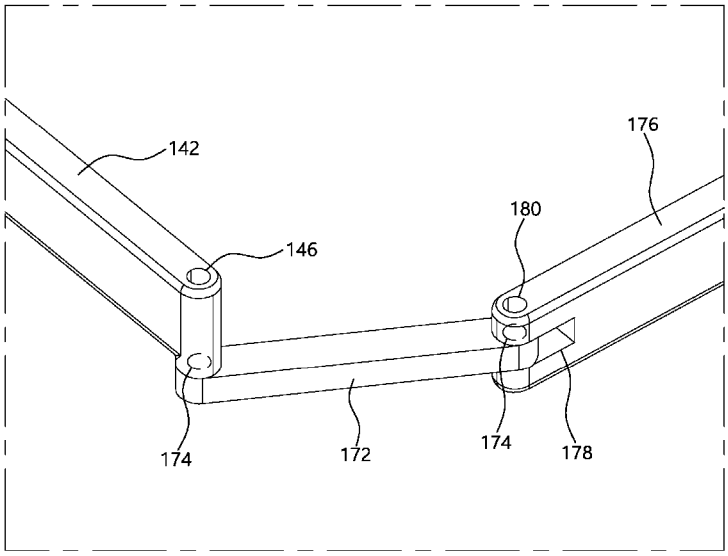
FIG. 13 is a partially enlarged view illustrating a state in which the back and forth moving member is fixed to a second gear part according to the embodiment of the present disclosure.
Figure 14:
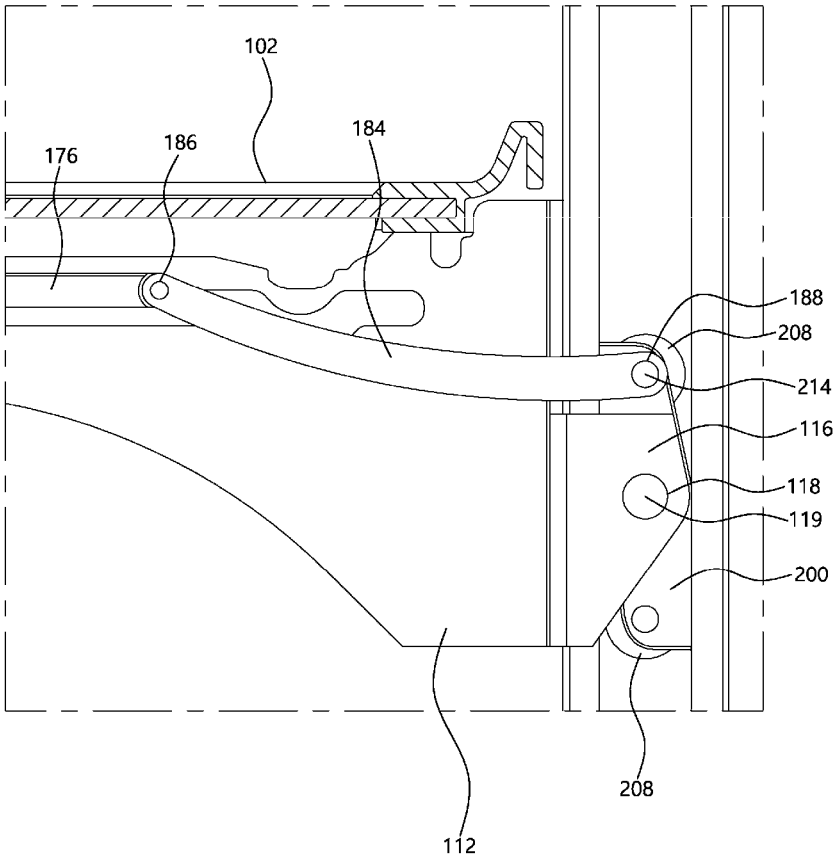
FIG. 14 is an enlarged view illustrating a state in which a back and forth moving bar, a rotation guide bar, and a holding member are coupled to each other according to the embodiment of the present disclosure.
Figure 15:
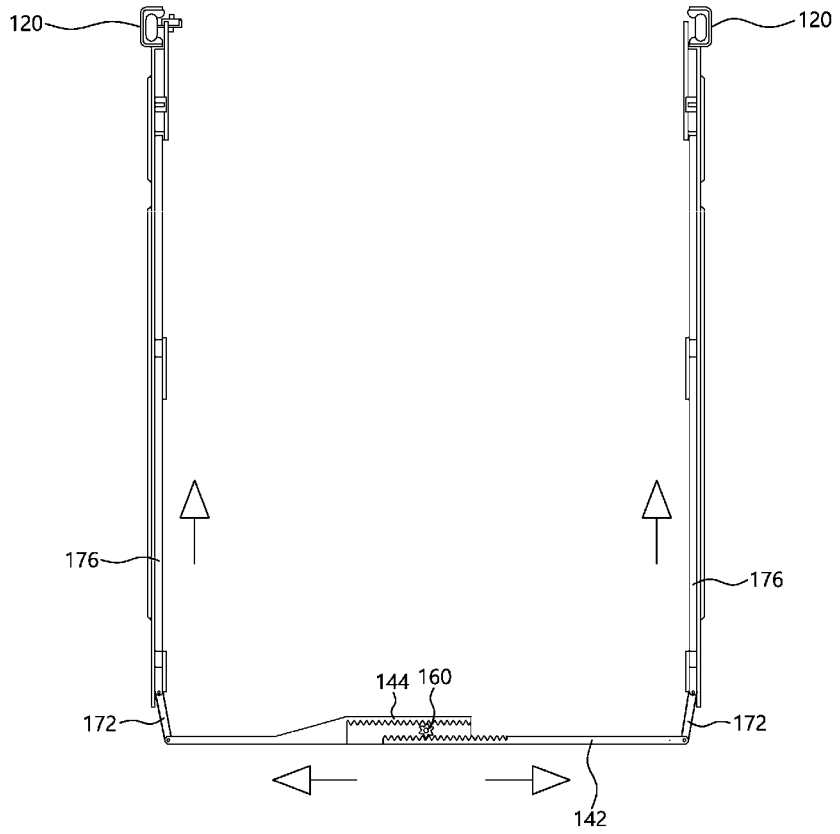
FIG. 15 is a top plan view illustrating a state in which the back and forth moving member is moved rearward by manipulating the lift module according to the embodiment of the present disclosure.

FIG. 12 illustrates a partially enlarged view illustrating a state in which the back and forth moving member is fixed to the first gear part according to the embodiment of the present disclosure, FIG. 13 illustrates a partially enlarged view illustrating a state in which the back and forth moving member is fixed to the second gear part according to the embodiment of the present disclosure, FIG. 14 illustrates an enlarged view illustrating a state in which the back and forth moving bar, a rotation guide bar, and the holding member are coupled to each other according to the embodiment of the present disclosure, and FIG. 15 illustrates a top plan view illustrating a state in which the back and forth moving member is moved rearward by manipulating the lift module according to the embodiment of the present disclosure.

As illustrated in FIGS. 12 to 15, hereinafter, the back and forth moving member 170 and the holding member 200 will be described in detail.

The back and forth moving member 170 may be installed on an end of each of the first gear part 142 and the second gear part 148. The back and forth moving member 170 may be fixed to the end part of each of the first and second gear parts 142 and 148, and may include the connection bar 172 rotated forward/rearward according to the leftward/rightward movement of the first and second gear parts 142 and 148, the back and forth moving bar 176 connected to the end part of the connection bar 172 and configured to move forward/rearward along the lower surface of the shelf 102 according to the forward/rearward rotation of the connection bar 172, and the rotation guide bar 184 formed in the shape of a bar, wherein the first end of the rotation guide bar 184 is fixed to the end part of the back and forth moving bar 176 and the second end of the rotation guide bar 184 is fixed to the holding member 200 such that the holding member 200 is rotated forward or rearward according to the forward/rearward movement of the back and forth moving bar 176.

The connection bar 172 may be installed on the end of each of the first and second gear parts 142 and 148. The connection bar 172 may be formed to have the shape of a bar and to be horizontally long. A third coupling hole 174 may be formed in each of the opposite sides of the connection bar 172. A coupling pin (not shown) may be inserted into the third coupling hole 174, and thus each of the first and second gear parts 142 and 148 or the back and forth moving bar 176 to be described later may be fixed rotatably to the connection bar 172.

The first end of the connection bar 172 may be coupled to each of the first and second gear parts 142 and 148, and the second end of the connection bar 172 may be coupled to the end of the back and forth moving bar 176 to be described later. The connection bar 172 may be installed between each of the first and second gear parts 142 and 148 and the back and forth moving bar 176 to be described later, and may function to move the back and forth moving bar 176 to be described later forward/rearward according to the leftward/rightward movement of each of the first and second gear parts 142 and 148.

That is, according to the leftward/rightward movement of each of the first and second gear parts 142 and 148, the connection bar 172 may be moved forward/rearward such that the forward/rearward movement of the back and forth moving bar 176 to be described later is performed.

The back and forth moving bar 176 may be installed on the end of the connection bar 172. The back and forth moving bar 176 may be formed to have the shape of a bar and to be long in the front-to-rear direction. The back and forth moving bar 176 may be installed to be long in the front-to-rear direction along each of the opposite sides of the lower surface of the shelf 102. The back and forth moving bar 176 may be coupled to the end of the connection bar 172 and may move forward/rearward according to the forward/rearward movement of the connection bar 172.

A coupling groove 178 may be formed in the front end part of the back and forth moving bar 176. The coupling groove 178 may be formed on the front end part of the back and forth moving bar 176 by being recessed by a predetermined thickness therefrom. The end of the connection bar 172 may be inserted into and fixed in the coupling groove 178.

A connection bar coupling hole 180 may be formed in the front upper surface of the back and forth moving bar 176. The connection bar coupling hole 180 may be formed vertically through the front upper surface of the back and forth moving bar 176. A coupling pin (not shown) may be inserted into the connection bar coupling hole 180 such that the back and forth moving bar 176 and the connection bar 172 are fixed rotatably to each other.

A guide bar coupling hole 182 may be formed in the rear side surface of the back and forth moving bar 176. The guide bar coupling hole 182 may be formed in a side to side direction through the side surface of the back and forth moving bar 176. A coupling pin (not shown) may be inserted into the guide bar coupling hole 182 such that the rotation guide bar 184 to be described later is fixed rotatably to the back and forth moving bar 176.

The rotation guide bar 184 may be installed on the rear end of the back and forth moving bar 176. The rotation guide bar 184 may be formed in the shape of a bar and may be configured to be rounded in an arc shape. The first end of the rotation guide bar 184 may be connected to the back and forth moving bar 176, and the second end of the rotation guide bar 184 may be connected to the holding member 200 to be described later. The rotation guide bar 184 may function to rotate the holding member 200 in a forward/rearward direction according to the forward/rearward movement of the back and forth moving bar 176.

First and second guide bar fixing holes 186 and 188 may be formed respectively on the front and rear of the rotation guide bar 184. The first and second guide bar fixing holes 186 and 188 may be respectively formed through the front and rear side surfaces of the rotation guide bar 184 in the side to side direction. A coupling pin (not shown) may be inserted into the first guide bar fixing hole 186 such that the rotation guide bar 184 and the back and forth moving bar 176 are coupled to each other.

A first roller fixing pin 214 to be described later may be inserted into the second guide bar fixing hole 188 such that the rotation guide bar 184 is coupled to a lift body 202.

Figure 16:
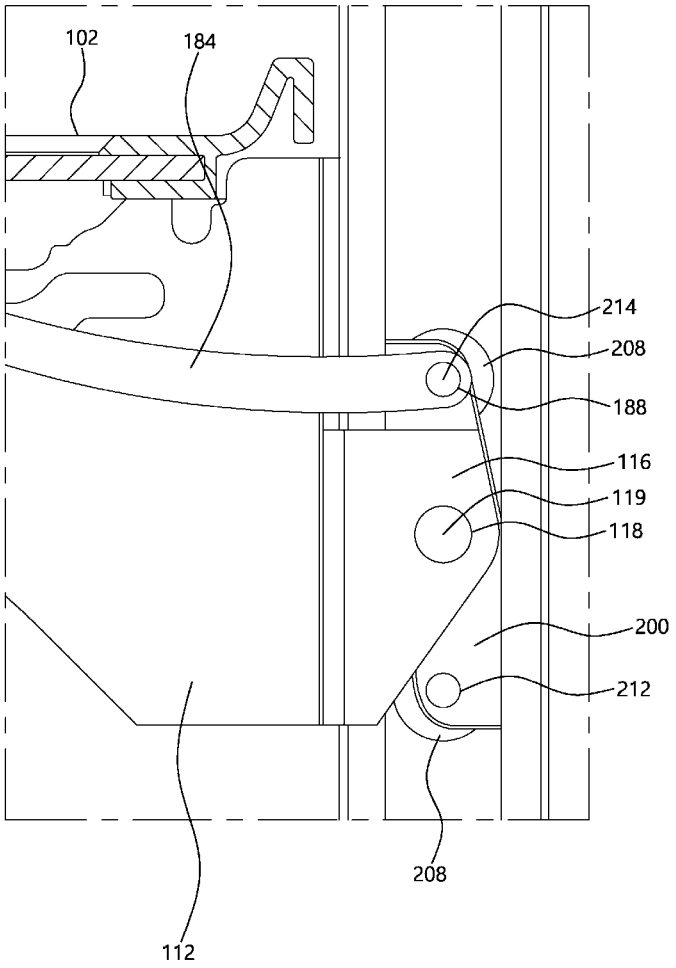
FIG. 16 is an enlarged view illustrating a state in which the holding member is held in a lift rail module according to the embodiment of the present disclosure.
Figure 17:
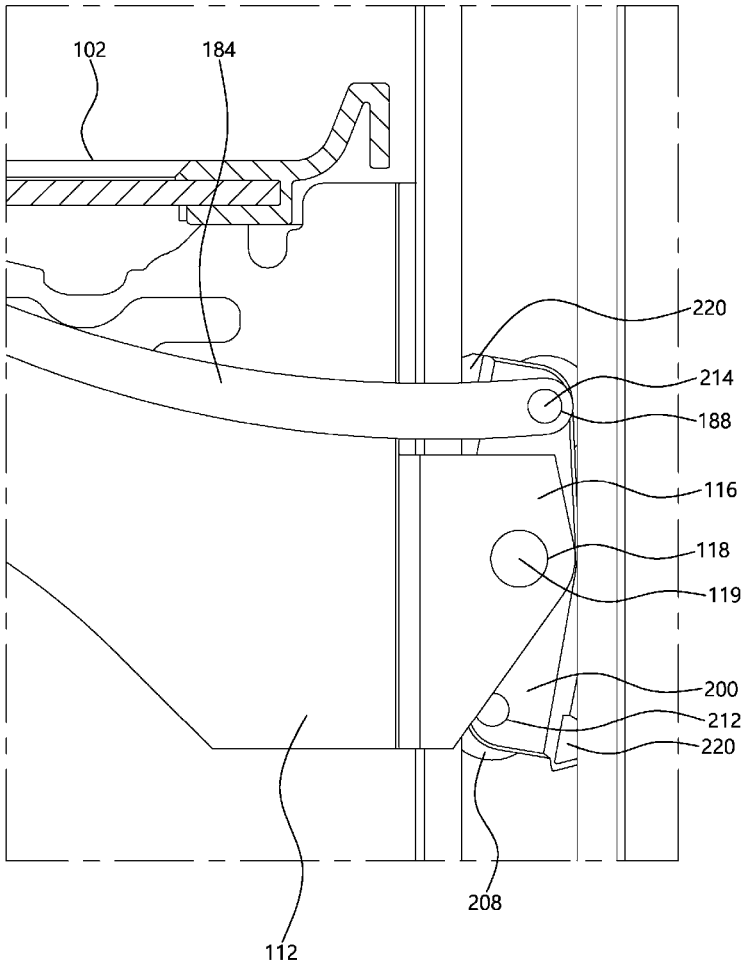
FIG. 17 is an enlarged view illustrating a state in which the holding member is rotated rearward and released from the lift rail module according to the embodiment of the present disclosure.
Figure 18:
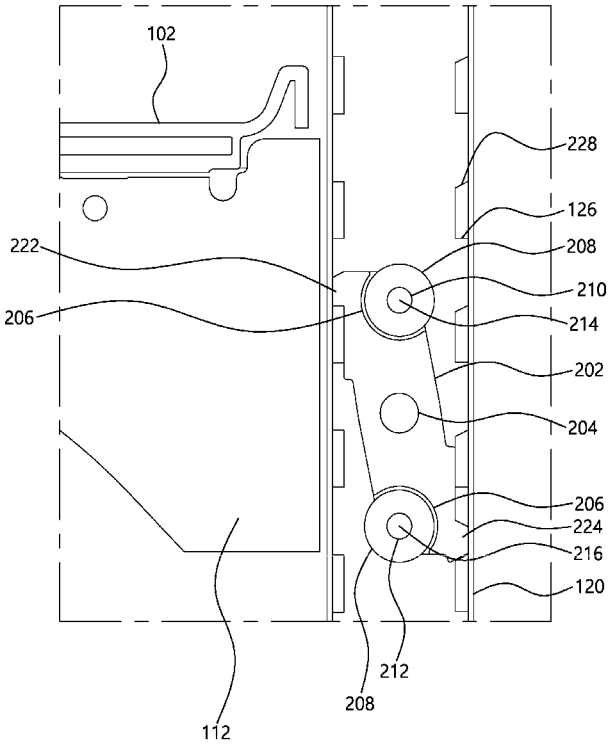
FIG. 18 is an enlarged sectional view illustrating a state in which the holding member is held in the lift rail module according to the embodiment of the present disclosure.
Figure 19:
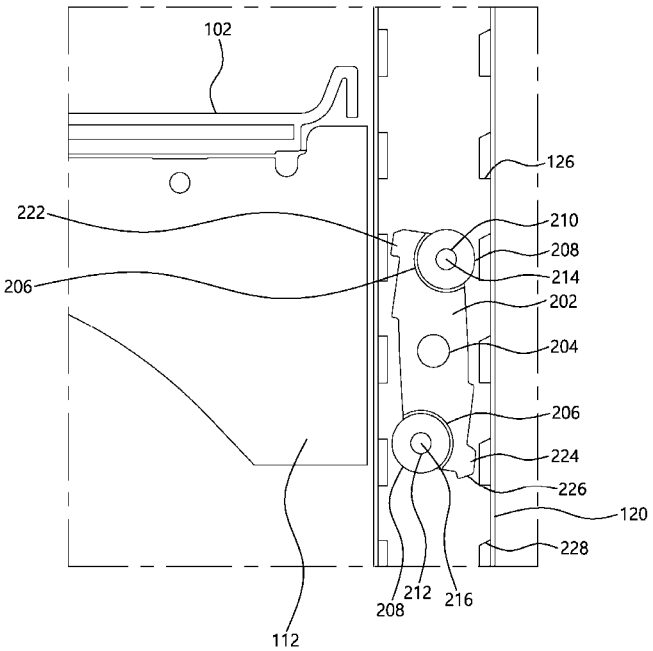
FIG. 19 is an enlarged sectional view illustrating a state in which in the lift rail module, the holding member is released from a holding recess to the outside thereof due to the rotation of the holding member according to the embodiment of the present disclosure.

FIG. 16 is an enlarged view illustrating a state in which the holding member is held in the lift rail module according to the embodiment of the present disclosure, FIG. 17 is an enlarged view illustrating a state in which the holding member is rotated rearward and released from the lift rail module according to the embodiment of the present disclosure, FIG. 18 is an enlarged sectional view illustrating a state in which the holding member is held in the lift rail module according to the embodiment of the present disclosure, and FIG. 19 is an enlarged sectional view illustrating a state in which in the lift rail module, the holding member is released from the holding recess to the outside thereof due to the rotation of the holding member according to the embodiment of the present disclosure.

As illustrated in FIGS. 16 to 19, the holding member 200 may be mounted to the end of the rotation guide bar 184. The holding member 200 may be provided inside the lift rail module 120 and allow a side of the shelf fixing bracket 110 to be fixed to the holding member 200, and may be composed of the lift body 202 installed to be vertically movable along the lift rail module 120, and the holding protrusion 220 formed on one side of the lift body 202 by protruding therefrom and held on the inner surface of the lift rail module 120 according to the rotation of the lift body 202.

The lift body 202 may be installed inside the lift rail module 120. The lift body 202 may be formed in the shape of a rectangular block to be vertically long. The lift body 202 may be installed inside the lift rail module 120 and may move upward and downward.

The lift body 202 may have a bracket fixing hole 204 formed in a center thereof. The bracket fixing hole 204 may be formed through the side surface of the lift body 202. The bracket fixing pin 119 may be inserted into the bracket fixing hole 204 so as to securely hold the fixing piece 116 of the shelf fixing bracket 110 and the lift body 202.

Roller mounting recesses 206 may be formed respectively on the right upper end part and left lower end part of the lift body 202. The roller mounting recesses 206 may be formed in arc shapes respectively on the upper rear and lower front of the lift body 202 by being recessed therefrom. A portion of the roller 208 to be described later may be inserted into each of the roller mounting recesses 206 to be fixed rotatably thereto.

The roller 208 may be installed inside the roller mounting recess 206. The roller 208 is a general roller, so detailed description thereof will be omitted.

The roller 208 may be installed rotatably inside the roller mounting recess 206, and may roll while contacting with the inner surface of the lift rail module 120 during the vertical movement of the lift body 202 so as to guide the vertical movement of the lift body 202.

First and second roller mounting holes 210 and 212 may be formed respectively on the upper and lower sides of the lift body 202. The first roller mounting hole 210 may be formed at a right side relative to the bracket fixing hole 204, and the second roller mounting hole 212 may be formed at a left side relative to the bracket fixing hole 204. The first and second roller mounting holes 210 and 212 may be formed through the upper and lower sides of the lift body 202. First and second roller fixing pins 214 and 216 may be inserted respectively into the first and second roller mounting holes 210 and 212 such that the rollers 208 to be described later are fixed rotatably inside the lift body 202.

In addition, the first roller fixing pin 214 may be inserted into the second guide bar fixing hole 188 of the rotation guide bar 184 and the first roller mounting hole 210 so as to couple the first roller fixing pin 214 thereto, so the rotation guide bar 184 may be fixed to the lift body 202, and the roller 208 may be fixed rotatably to the lift body 202.

In addition, the rotation guide bar 184 may be fixed to the portion of the first roller mounting hole 210 located at the upper side of the lift body 202, and thus according to the leftward/rightward movement of the rotation guide bar 184, the lift body 202 may be rotate leftward or rightward relative to the bracket fixing pin 119.

The holding protrusion 220 may be formed on each of the upper side of a left surface of the lift body 202 and the lower side of a right surface thereof. The holding protrusion 220 may include a first holding protrusion 222 formed on the upper side of the lift body by protruding therefrom, and a second holding protrusion 224 formed on the lower side of the lift body by protruding therefrom.

The first holding protrusion 222 may be formed the upper side of the left surface of the lift body 202 by protruding leftward therefrom. The first holding protrusion 222 may be held in the holding recess 126 formed in the left surface of the lift rail module 120 when the lift body 202 is rotated leftward.

The second holding protrusion 224 may be formed on the lower side of the right surface of the lift body 202 by protruding rightward therefrom. The second holding protrusion 224 may be held in the holding recess 126 formed in the right surface of the lift rail module 120 when the lift body 202 is rotated leftward.

Furthermore, a holding guide surface 226 may be formed on the lower surface of the second holding protrusion 224. The holding guide surface 226 may be formed to be inclined at a predetermined angle. The holding guide surface 226 may be formed to be inclined at the same angle as the angle of a lower inner surface 228 of the holding recess 126 formed in the right surface of the lift rail module 120.

During the holding of the second holding protrusion 224, the holding guide surface 226 may be in close contact with and held by the inclined lower inner surface of the holding recess 126.

As described above, each of the holding guide surface 226 and the lower inner surface 228 of the holding recess 126 formed in the right surface of the lift rail module 120 may be formed to be inclined, and thus when releasing the holding of the holding member 200, the second holding protrusion 224 may be efficiently released from the holding recess 126.

The holding protrusions 220 of the holding member 200 may be simultaneously held in the holding recesses 126 formed respectively in the left and right surfaces of the lift rail module 120, and thus the shelf 102 may be more securely held by the lift rail module 120.

Hereinafter, the operation of the shelf assembly of the refrigerator of the present disclosure having the above configuration will be described with reference to FIGS. 1 to 19.

First, in order for a user to adjust the height of the shelf, the user may grip the handle part 144 of the lift module 140 located on the front edge part of the shelf and then slidably move the handle part in the right direction.

According to the movement of the handle part 144 in the right direction, the first gear part 142 formed to be integrated with the handle part 144 may be moved in a rightward direction, and thus the rotating gear part 160 engaged with the first gear part 142 may be rotated.

Due to the rotation of the rotating gear part 160, the second gear part 148 engaged with the rotating gear part 160 may be moved in a leftward direction contrary to the moving direction of the first gear part.

That is, due to the sliding of the handle part 144 in the right direction, the first and second gear parts 142 and 148 may be simultaneously moved in the right and left directions, respectively, along the front lower part of the shelf 102.

When the first and second gear parts 142 and 148 move respectively in the rightward and leftward directions of the shelf 102, the connection bar 172, the back and forth moving bar 176, and the rotation guide bar 184 of the back and forth moving member 170 connected to each of the first and second gear parts 142 and 148 may be sequentially moved rearward.

In addition, the lift body 202 of the holding member 200 connected to the rotation guide bar 184 may be rotated rearward, and the holding protrusion 220 held in the holding recess 126 of the lift rail module 120 may be released.

The shelf held by the lift rail module 120 may be released therefrom by the operation of the lift module 140 described above, and the shelf may be moved to a position desired by a user.

When the shelf is located at the position desired by the user, an operation contrary to the operation of releasing the holding of the lift module 140 may proceed and thus the shelf 102 may be securely held by the lift rail module 120.

The scope of the present disclosure is not limited to the embodiment illustrated above, and many other modifications based on the present disclosure will be possible for those skilled in the art within the technical scope as described above.

The invention claimed is:

1. A refrigerator comprising a shelf assembly, wherein the shelf assembly comprises:

a shelf installed inside a cabinet defining a storage space of the refrigerator and allowing food and a container to be seated thereon;

a shelf fixing bracket fixed to each of opposite sides of the shelf and supporting the shelf;

a lift rail module installed to be vertically long inside the cabinet such that the shelf fixing bracket is vertically movable; and a lift module installed slidably on one side of the shelf and configured to selectively release the shelf fixing bracket held by the lift rail module according to a user's manipulation, wherein the lift module comprises:

a first gear part installed on one side of the shelf such that the first gear part is movable leftward and rightward and having a plurality of teeth formed along one surface thereof, a second gear part installed on one side of the shelf such that the second gear part is movable leftward and rightward and having a plurality of teeth formed along one surface thereof, a rotating gear part installed between the first gear part and the second gear part and having a plurality of teeth formed along a circumferential surface thereof such that the first gear part and the second gear part are engaged with each other, a back and forth moving member connected to each of the first and second gear parts and installed on one side of the shelf so as to move forward/rearward, a handle part provided on one side of the first gear part and installed to cover a front edge part of the shelf, the handle part being configured to move the first gear part leftward or rightward according to a user's manipulation, and a holding member connected to the back and forth moving member and installed inside the lift rail module, the holding member selectively being held by the lift rail module according to the forward/rearward movement of the back and forth moving member.

2. The refrigerator of claim 1, wherein the first gear part and the handle part are formed to be integrated with each other.

3. The refrigerator of claim 1, wherein the rotating gear part is rotated clockwise/counterclockwise according to the leftward/rightward movement of the first gear part so as to move the second gear part in a leftward/rightward direction.

4. The refrigerator of claim 1, wherein the back and forth moving member comprises:

a connection bar fixed to an end part of each of the first and second gear parts and configured to be rotated forward/rearward according to the leftward/rightward movement of each of the first and second gear parts;

a back and forth moving bar connected to an end part of the connection bar and configured to move forward/rearward along a lower surface of the shelf according to forward/rearward rotation of the connection bar; and a rotation guide bar formed to have a shape of a bar, wherein a first end of the rotation guide bar is fixed to an end part of the back and forth moving bar, and a second end of the rotation guide bar is fixed to the holding member such that the holding member is rotated forward/rearward according to the forward/rearward movement of the back and forth moving bar.

5. The refrigerator of claim 1, wherein the holding member comprises:

a lift body provided inside the lift rail module and fixed to one side of the shelf fixing bracket, the lift body being installed to be vertically movable along the lift rail module, and a holding protrusion formed on one side of the lift body by protruding therefrom and held on an inner surface of the lift rail module according to rotation of the lift body.

6. The refrigerator of claim 5, wherein a plurality of holding recesses are formed at predetermined intervals in an inner surface of the lift rail module by being recessed therefrom.

7. The refrigerator of claim 6, further comprising:

a roller provided to have a roller shape on each of upper and lower sides of the lift body, and configured to roll while contacting with the inner surface of the lift rail module during the vertical movement of the lift body.

8. The refrigerator of claim 7, wherein the holding protrusion is formed on each of a front upper side of the lift body and a rear lower side of the lift body by protruding therefrom.

9. The refrigerator of claim 8, wherein the plurality of holding recesses are formed at the predetermined intervals on each of front and rear sides of the inner surface of the lift rail module by being recessed therefrom, and when the lift body is held inside the lift rail module, the holding protrusion of the front side of the lift body and the holding protrusion of the rear side thereof are simultaneously held respectively in a holding recess of the front side and a holding recess of the rear side.

* * * * *